US005655424A

United States Patent [19]

Takeda et al.

[11] Patent Number: 5,655,424

[45] Date of Patent: Aug. 12, 1997

[54] ROLLER CUTTING METHOD AND APPARATUS FOR A PLURAL-ROLL ROLLING MILL

[75] Inventors: Ryo Takeda; Hidenori Kondo; Yoshihiro Shinkai, all of Okayama, Japan

[73] Assignee: Kawasaki Steel Corporation, Japan

[21] Appl. No.: 492,608

[22] Filed: Jun. 20, 1995

[30] Foreign Application Priority Data

Jun. 29, 1994 [JP] Japan ..... 6-147930

[51] Int. Cl.[6] ..... B23B 5/08; B21B 28/02

[52] U.S. Cl. ..... 82/104; 82/117; 82/129; 409/165; 29/29

[58] Field of Search ..... 82/103–105, 117, 82/129; 409/165; 29/27 R, 27 C, 29

[56] References Cited

U.S. PATENT DOCUMENTS

| | | | |
|---|---|---|---|
| 4,827,751 | 5/1989 | Holthoff | 451/22 |
| 5,134,910 | 8/1992 | Morikuni et al. | 82/1.11 |

FOREIGN PATENT DOCUMENTS

| | | |
|---|---|---|
| 0 300 230 | 1/1989 | European Pat. Off. . |
| 0 335 286 | 10/1989 | European Pat. Off. . |
| B-25 03 284 | 7/1976 | Germany . |
| 63-237801 | 10/1988 | Japan . |
| 60 063 601 | 3/1994 | Japan . |

*Primary Examiner*—Maurina T. Rachuba
*Assistant Examiner*—Kenneth J. Hansen
*Attorney, Agent, or Firm*—Austin R. Miller

[57] ABSTRACT

In a plural-roll rolling mill having a pass line arranged by the respective sets of rolls, each having a caliber formed on the outside peripheral surface thereof, the outside peripheral surfaces being disposed close to each other, the calibers of the rolls being cut with a cutting tool of a three-dimensionally (forward and rearward, rightward and leftward and upward and downward) movable cutting machine. The rolling mill, which has a reference column disposed on the outside surface thereof at a position spaced apart from the pass line by a predetermined distance, is removed from a rolling line and fixed, and the positional alignment of the cutting tool is carried out by causing a contact sensor disposed on the cutting machine at a position spaced apart from the cutting tool by a predetermined distance to come into contact with the reference column. With this arrangement, there are provided a method and apparatus capable of cutting the rolls of the plural-roll rolling mill while mounted on the rolling mill.

10 Claims, 6 Drawing Sheets

FIG. IA
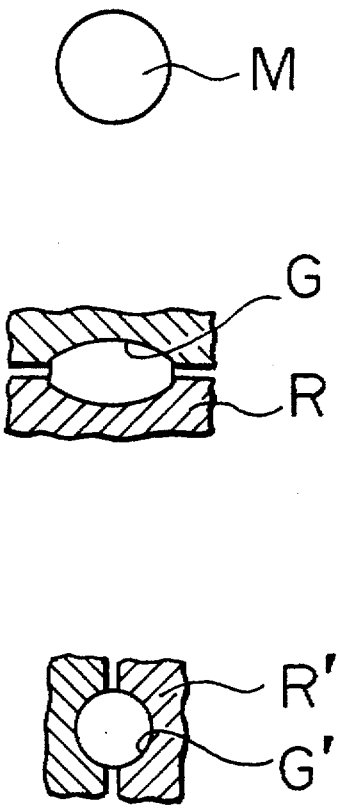
FIG. IB
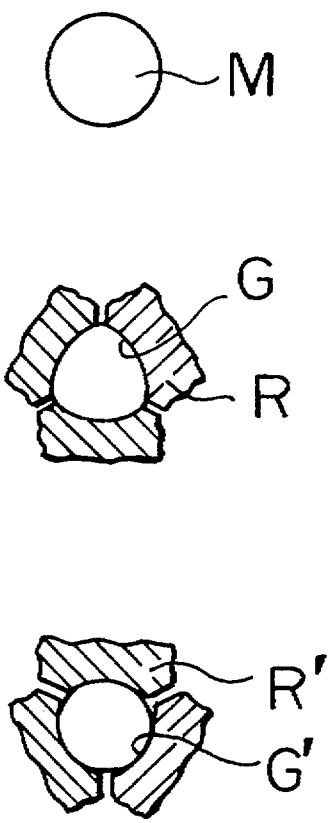
FIG. IC
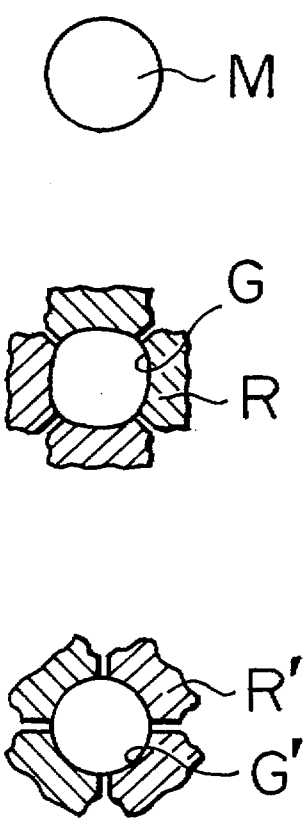

ROLLER CUTTING METHOD AND APPARATUS FOR A PLURAL-ROLL ROLLING MILL

BACKGROUND OF THE INVENTION

1. Field of the Invention

The present invention relates to a method and apparatus for cutting the rolls of a plural-roll rolling mill without removing the rolls from the rolling mill.

2. Description of the Related Art

Methods of rolling wire rods and steel bars in sizing mills can be grouped according to the number of pairs of rolls used in a stand; i.e., two-roll, three-roll and four-roll methods. As shown in FIGS. 1A–1C, such methods involve rolling a material M through a plurality of passes by pairs of rolls (R, R') whose peripheral surfaces are provided with grooves (G, G') formed to predetermined sectional shapes. In general, dimensional accuracy of the product increases with the number of rolling pairs employed.

A four-roll rolling method is disclosed in, for example, Japanese Patent Application Laid-Open No. 6(1994)-63601 and U.S. Pat. No. 5,363,682. Since the surface of the roll calibers is worn or roughed after a time, the calibers are usually recut to enable reuse of the rolls.

The calibers are conventionally recut by removing the rolls from the rolling mill. However, the conventional method deteriorates mill productivity since dismounting and remounting the rolls requires the stoppage of rolling operations and consumes much time. Further, detaching and reattaching the rolls is a dangerous operation that requires considerable skill and manpower.

Japanese Patent Application Laid-Open No. 63(1988)-237801 and the document "Precise Rolling of Steel Bars by Three-Directional Finishing Rolls" (Symposium on Plastic Working, Vol. 139, pages 23–29, 1991) disclose means for cutting roll calibers while the rolls are mounted.

Japanese Patent Application Laid-Open No. 63(1988)-237801 discloses a method of cutting the stand-mounted rolls of a two-roll rolling mill. According to the method, the rolling mill is removed from a rolling line and is horizontally aligned by fixing the position of the rolling mill through use of a pusher. The backlash of the roll is removed by rotating the roll while simultaneously pushing the roll in the thrust direction of a roll axis. A radial preload mechanism prevents radial movement of the roll. However, since the roll to be cut is not pushed toward a pass line, the roll has backlash in the direction of the pass line which greatly disperses the cutting margin of the roll.

The method disclosed in "Precise Rolling of Steel Bars by Three-Directional Finishing Rolls" (in FIG. 5, page 26) is a method for cutting the rolls of a three-roll type rolling mill. According to the method, the caliber of each of the rolls is ground while removing the backlash of the roll by inserting a conical grinding stone (ring cutting tool) between the three rolls. However, grinding the caliber serves to increase machining time, and the grinding itself requires considerable skill because the machined shape of a roll is changed by the wear caused by the cutting tool. Moreover, the method does not describe any means by which the rolls of the rolling mill can be cut as mounted on the rolling mill, particularly on a four-roll rolling mill.

Accordingly, an object of the present invention is to provide a method and apparatus by which the rolls of a plural-roll rolling mill can be cut as mounted on the rolling mill.

SUMMARY OF THE INVENTION

To achieve the above object of cutting rolls as mounted on a four-roll rolling mill, there is provided a method of cutting the two horizontal rolls and the two vertical rolls, each of which has a caliber formed on the outside peripheral surface thereof. A pass line is arranged by disposing the two horizontal rolls and the two vertical rolls such that the outside peripheral surfaces are close to each other. The rolling mill, which has a reference column disposed on the outside surface thereof at a position spaced apart from the pass line by a predetermined distance, is removed from a rolling line and fixed. A cutting tool of a movable cutting machine is aligned three-dimensionally (forward and rearward, rightward and leftward, upward and downward) by causing a contact sensor disposed on the cutting machine at a position spaced apart from the cutting tool by a predetermined distance to come into contact with the reference column. The calibers of the four rolls are then cut with the cutting tool.

The rolls can be cut such that backlash of the roll shafts in the thrust direction and in the path line direction is removed. This is accomplished by pushing the respective rolls toward the pass line until the rolls abut against each other. It is preferable that in order to prevent friction on each of the outside peripheral surfaces of the rolls abut to be caused by a different rotation velocity thereof, each of the outside peripheral surfaces against which neighboring horizontal and vertical rolls abut has a taper surface set to about 45°.

An apparatus for achieving the above method comprises a base table for fixing a rolling mill thereon. The mill has a reference column disposed on its outside surface at a position spaced from the pass line by a predetermined distance. A cutting machine which has a cutting tool for cutting the rolls, as well as a contact sensor disposed at a position spaced from the cutting tool by a predetermined distance, is provided. The cutting machine is disposed on a table adjustable in the forward, rearward, rightward, leftward, upward and downward directions. Horizontal roll drive sources which are movably disposed and detachably connected to the support shaft of each of the horizontal rolls are provided to rotate the horizontal rolls during the cutting operation. Similarly, vertical roll drive sources, each of which is movably disposed and detachably connected to the support shaft of each of the vertical rolls, rotate the vertical rolls during the cutting operation.

It is preferable to provide a pusher for pushing the rolls toward the pass line, thus removing the backlash of the respective rolls in the cutting operation. It is also preferable to employ a contact sensor which is extendible and contractible.

BRIEF DESCRIPTION OF THE DRAWINGS

FIG. 1A, FIG. 1B and FIG. 1C are schematic views showing an example of a two-roll method (A), three-roll method (B) and four-roll method (C);

DETAILED DESCRIPTION OF THE INVENTION

Figure 2:
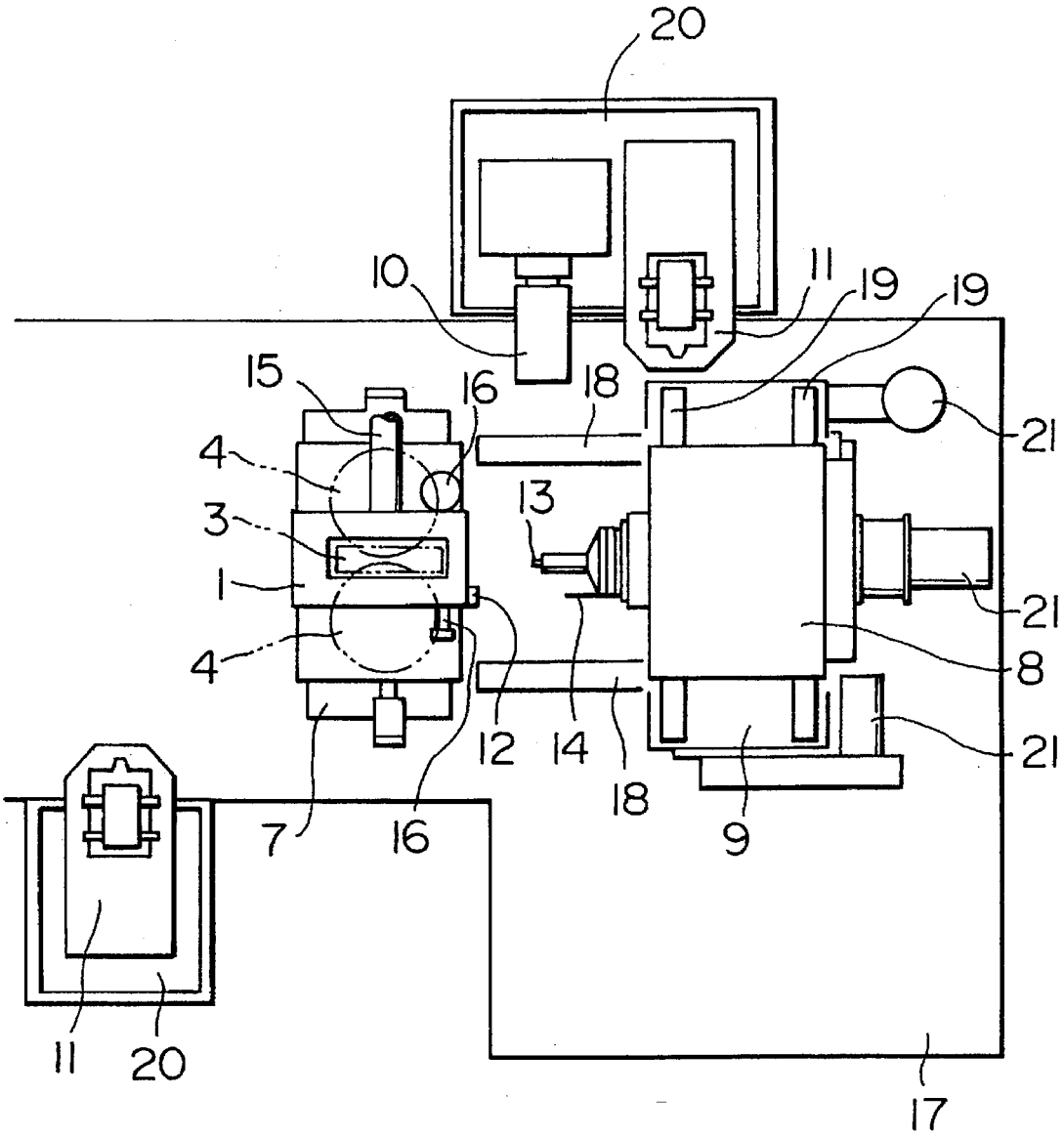
FIG. 2 is a plan view showing an embodiment of an apparatus according to the present invention.

A method according to the present invention will be described below involving an apparatus according to the present invention.

First, a two, three or four-roll rolling mill is removed from a rolling line and fixed on a base table. Each roll is then aligned with respect to a cutting tool by moving the positionally adjustable base on which the cutting machine is held. A contact sensor on the cutting machine is caused to come into contact with a reference column disposed on the outside surface of the rolling mill.

Since the reference column is disposed at a position spaced from the pass line by a predetermined distance, and the contact sensor is disposed at a position spaced from the cutting tool by a predetermined distance, it can be determined whether the cutting tool is located at a preset reference position with respect to each roll by abutting the contact sensor against the reference column. Thus, when the cutting tool is not located at the preset reference position, the cutting tool is aligned by moving the position adjusting base as required.

It is understood that the sensor used for the aforesaid positional alignment is not limited to the combination of the contact sensor and the reference column. For example, an optical sensor, e.g., a laser sensor, may be used.

The positional alignment is accomplished as follows. Referring to FIG. 4, the rolls mounted on a four-roll rolling mill include two coplanar rolls (3, 3) and two other coplanar rolls (4, 4). The respective axes (15) are aligned such that they are disposed on the same plane, and the lines extended from the axes (15) are substantially perpendicular to each other. That is, the rolls mounted on the rolling mill are symmetrically oriented around the pass line (2) (FIG. 1 and FIG. 4), the pass line being defined as a center through which a rolling material passes, and preferably as the intersection of an X-axis and a Y-axis corresponding to the axes of the rolls. The pass line is located at a position spaced from the outside surface of the rolling mill by a predetermined distance. Consequently, the machining reference point (or coordinate) of the cutting machine with respect to the two, three or four rolls can be determined by accurately establishing a set position relative to the pass line Z—Z on the outside surface of the rolling mill (refer to FIG. 3).

After completing the positional alignment process, a horizontal roll drive source (or a vertical or angular roll drive source) is moved and connected to the support shaft of the horizontal or angular roll (or the vertical or angular roll). It will be appreciated that the respective sets of rolls do not need to be horizontal or vertical but may be tilted to various angles if desired. In the description which follows, and in the solicited claim, we will refer to "horizontal" and "vertical" rolls as a matter of convenience and without limiting the scope of the invention in that regard. The concave caliber of the horizontal roll (or the vertical roll) is cut with the cutting tool to a desired shape by rotating the horizontal roll (or the vertical roll) with a drive source.

Each of the horizontal rolls and the vertical rolls inevitably possesses backlash at the respective portions of a bearing, bearing case, support shaft and the like (FIG. 5), thus causing a slight dislocation downward of each roll by its dead-weight. Cutting a downwardly dislocated roll decreases the machining accuracy of the roll caliber.

This problem is solved in the present invention by cutting the concave calibers only after the rolls are pushed toward the pass line by a pusher until the outside peripheral surfaces of the rolls contact each other (that is, when the rolls are disposed at the reference positions), thereby allowing accurate cutting of the concave surface of the caliber.

Further, when an extendible and contractible contact sensor is utilized in the apparatus according to the present invention, the contact sensor extends to confirm positional alignment, then retracts so as to not obstruct the cutting operation.

An embodiment of the apparatus of the present invention is shown in FIG. 2 (plan view).

In the embodiment, a base table (7) for holding a rolling mill (1) thereon and a cutting machine (8) for carrying out cutting operations are disposed on a flat machining table (17) such that the rear surface of rolling mill (1) is parallel with the front surface of cutting machine (8).

Since base table (7) is unmovably fixed on machining table (17) and rolling mill (1) is unmovably fixed on base table (7), rolling mill (1) is unmovable. A reference column (12) projects from the rear surface of rolling mill (1).

A cutter position adjusting base (9) is arranged such that it can be freely moved forward, rearward, rightward, leftward, upward and downward by motors (21). A pair of main rails (18) disposed on machining table (17) and traveling in the forward and rearward directions, a pair of sub-rails (19) traveling in the right and left directions, and a pair of guide rails in the upward and downward directions (not shown) guide the movement of position adjusting base (9). Cutting machine (8) is assembled on sub-rails (19) which project through a fixing member (not shown). Cutting tool (13) projects from the front surface of cutting machine (8). Contact sensor (14) is disposed at a position spaced from cutting tool (13) by a predetermined distance.

Figure 3:
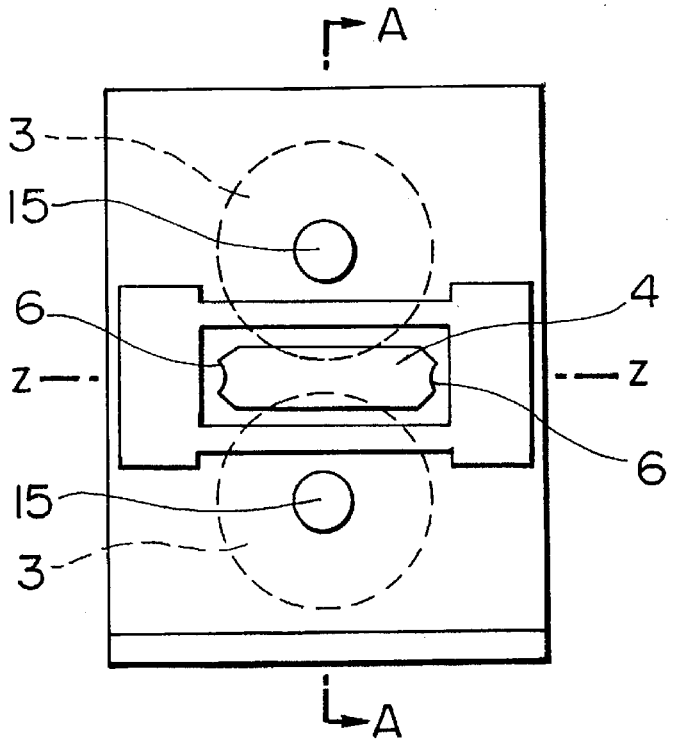
FIG. 3 is a front elevational view schematically showing a four-roll rolling mill as a subject of the present invention.
Figure 4:
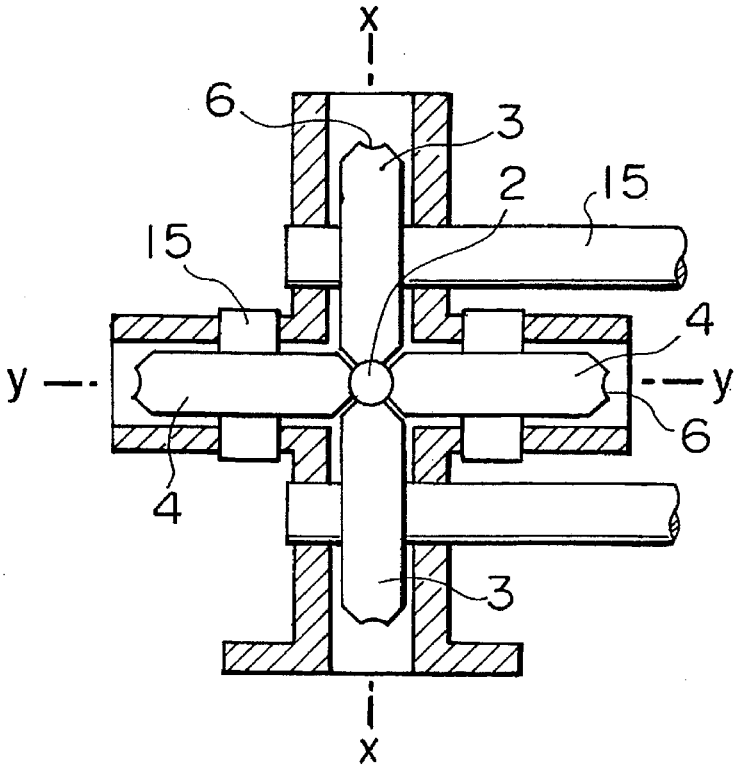
FIG. 4 is a cross sectional view taken along the line A—A of FIG. 3.
Figure 5:
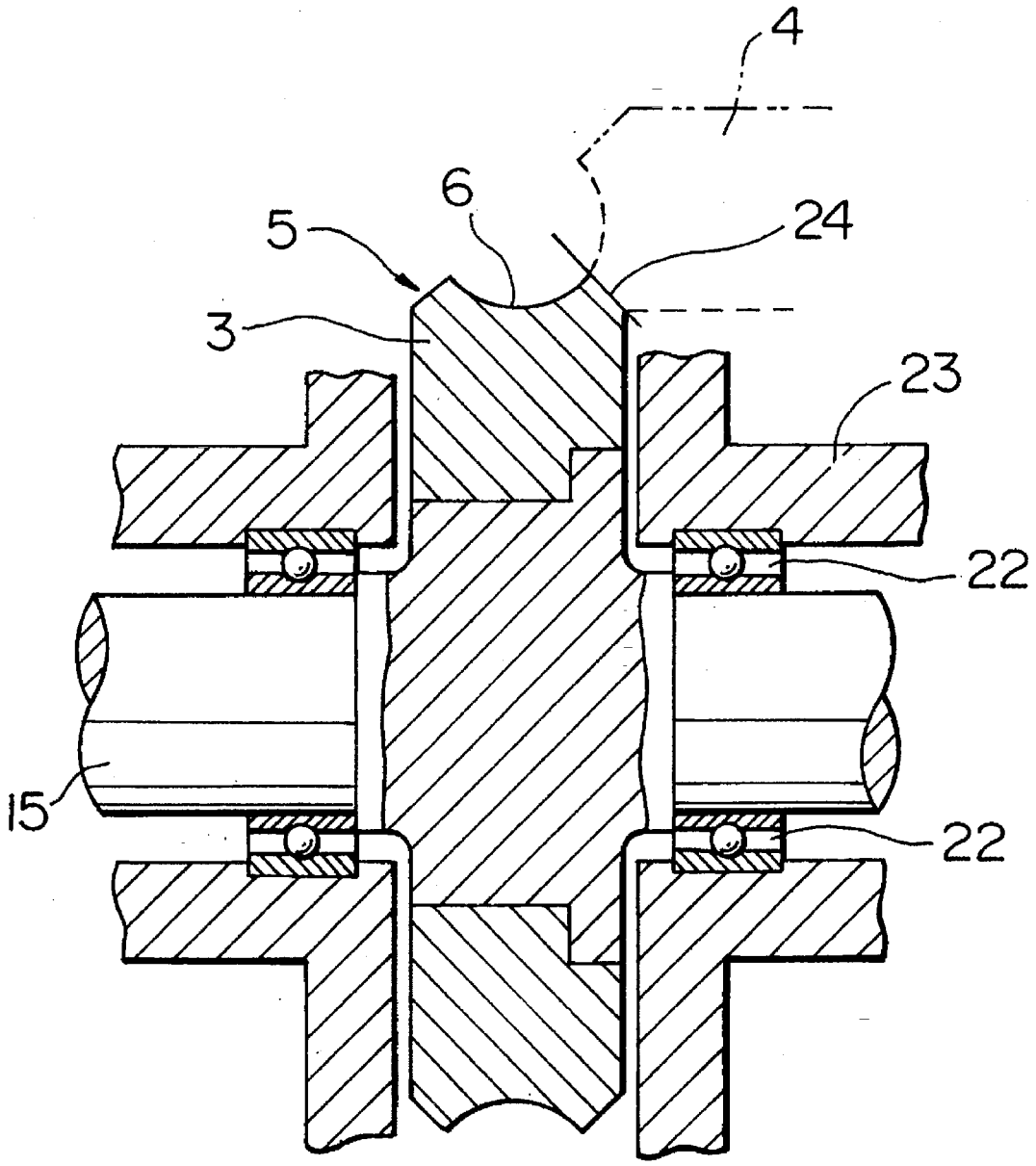
FIG. 5 is an enlarged view of a portion of the embodiment shown in FIG. 4.

Cutting machine (8) is a numerically controlled machine tool conventionally used by which the concave calibers (6) defined on the outside peripheral surfaces (5) of rolls (3) and (4) are automatically cut to predetermined shapes (refer to cavities (6) at FIGS. 3, 4 and 5).

A vertical roll drive source (11) and a horizontal roll drive source (10) are placed on a truck (20) and disposed on the right side of the machining table (17), movably and detachably connected to the support shafts (15) of vertical rolls (4) and horizontal rolls (3). Another vertical roll drive source (11), placed on a truck (20), is disposed on the left side of the machining table (17) (refer to FIG. 2). When horizontal roll (3) is to be cut, horizontal roll drive source (10) is connected to support shaft (15) of horizontal roll (3) and transmitting rotational force to rotate horizontal roll (3). Cutting tool (13) abuts against outside peripheral surface (5) of horizontal roll (3) and cuts caliber (6) to a predetermined shape. After completion of the cutting operation, horizontal roll drive source (10) is disconnected from support shaft (15) and returned to a predetermined position (refer to FIG. 2).

When caliber (6) of horizontal roll (3) is cut with cutting tool (13), horizontal roll drive source (10) is connected to and disconnected from support shaft (15) of horizontal roll (3). As an example of how this connection/disconnection may be accomplished, a male gear coupling may be provided at the extreme end of support shaft (15). A corresponding female gear coupling is provided at the spline extreme end of the output shaft of horizontal drive source (10), thus confronting the male gear coupling at the extreme end of the support shaft (15). The female gear coupling is advanced and retracted in accordance with the rotational direction of the output shaft of horizontal roll drive source (10) so that the female gear coupling is connected to and disconnected from the male gear coupling.

Likewise, when caliber (6) of vertical roll (4) is cut with cutting tool (13), vertical roll drive source (11) is connected to and disconnected from the support shaft (15) of vertical roll (4). Again, a gear may be integrally mounted on each vertical roll (4), and a gear fixed to the extreme end (lower end) of the output shaft of the motor of the vertical roll drive source (11) is meshed with the above above gear in accordance with the upward/downward displacement of vertical roll drive source (11) (refer to FIG. 2).

The present invention improves cutting accuracy by preventing the backlash of each of the four rolls (3), (4) by pushing the rolls toward pass line (2) by a pusher (16) during the cutting operation so that the outside peripheral surfaces (5) of the respective rolls lightly abut against each other. In the embodiment shown in FIG. 5, the backlash is removed by causing outside peripheral surfaces (5), each having a taper surface (24) set to 45°, to lightly abut against each other.

Figure 6C:
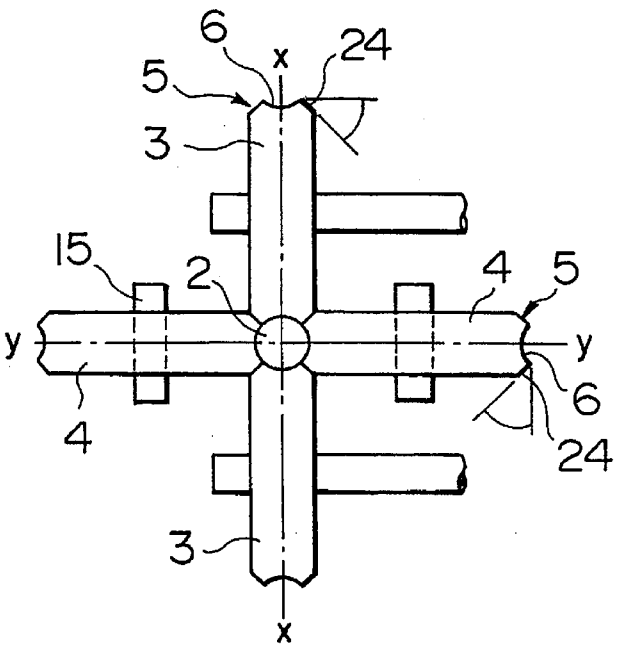
FIG. 6A, FIG. 6B and FIG. 6C are schematic views showing an example of a two-roll rolling mill(A), three-roll rolling mill(B) and four-roll rolling mill(C) of the present invention.
Figure 6B:
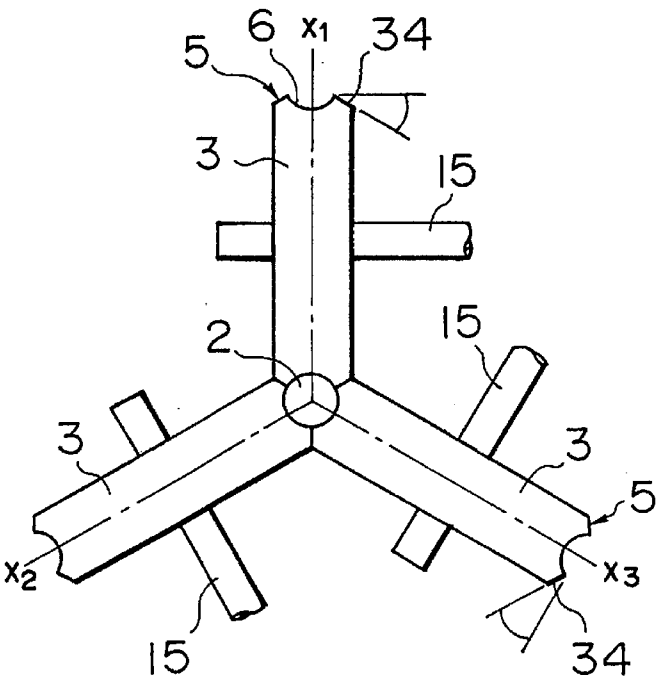
Figure 6A:
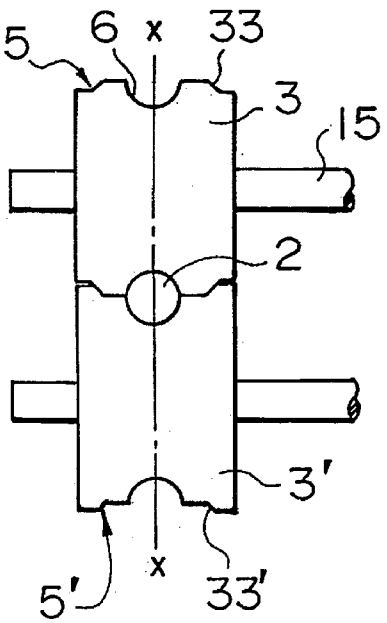

FIG. 6A, FIG. 6B and FIG. 6C are schematic views showing that the outside peripheral surfaces (5) of the respective rolls lightly abut against each other in a two-roll rolling mill(A), three-roll rolling mill(B) and four-roll rolling mill(C). The outside peripheral surfaces (5) has a step surface (33) of FIG. 6A, a taper surface (34) of FIG. 6B set to 30° or a taper surface (24) of FIG. 6C set to 45°.

Figure 7:
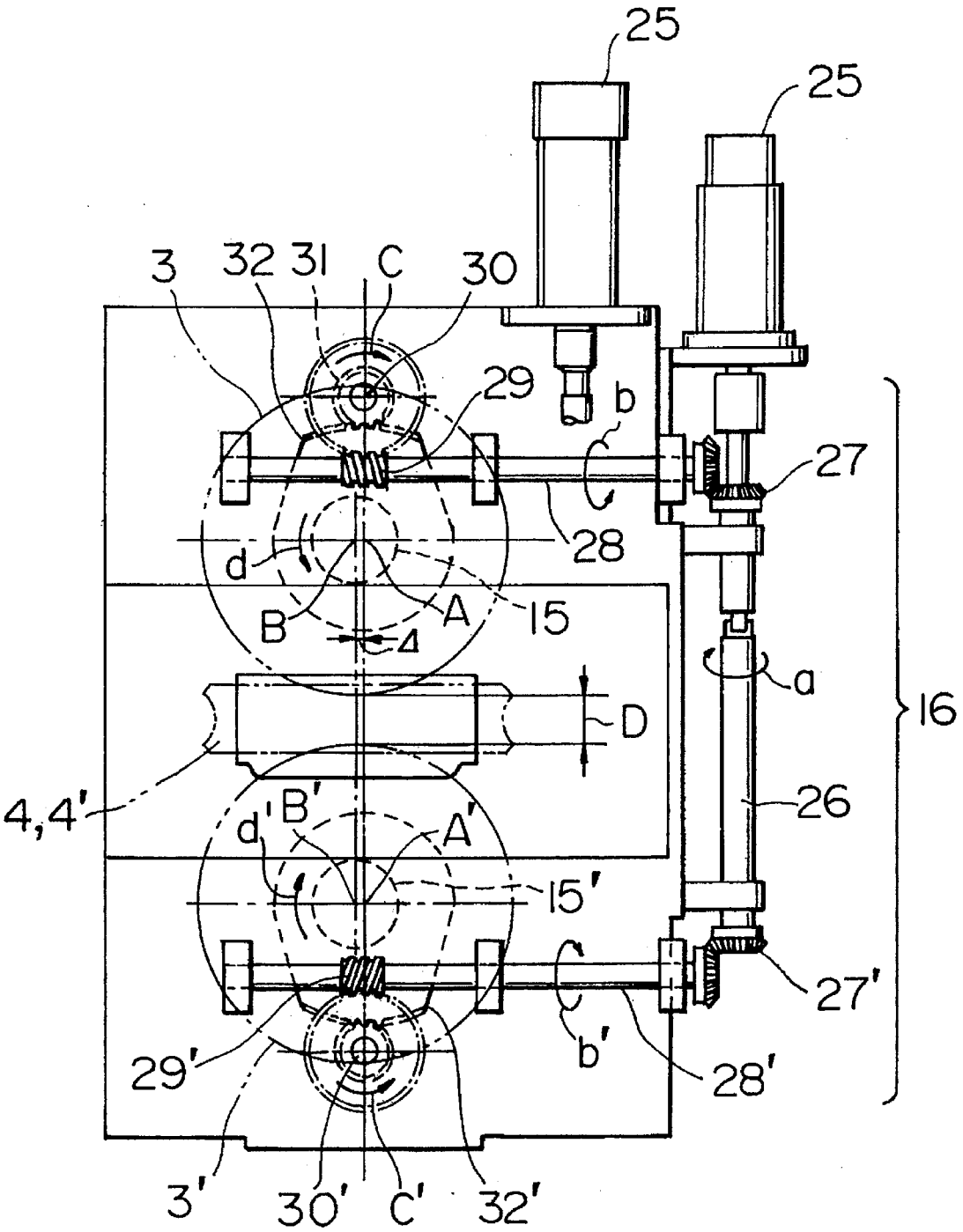
FIG. 7 is a view showing an example of a pusher of the present invention.

Pusher (16) pushes the rolls by utilizing the draft device of rolling mill (1). For example, FIG. 7 shows a draft device applied to a small-diameter steel bar. The draft device is arranged such that when shaft (26) is rotated in the direction of arrow (a) by a hydraulic motor (25), shaft (28) is rotated in the direction of arrow (b) through a bevel gear (27), shaft (30) is rotated in the direction of an arrow (c) through a worm gear (29), and eccentric bearing receiver (32) is rotated in the direction of an arrow (d) by spur gear (31) mounted on shaft (30). Axis A of eccentric bearing receiver (32) is thusly dislocated from axis B of roll support shaft (15) by an amount Δ so that roll axis A (i.e., roll (3)) is moved toward roll (3') by the rotation of the eccentric bearing receiver (32). Further, since roll (3') is arranged to move in contrast with roll (3), the rotation of shaft (26) in the direction of arrow (a) moves roll (3') toward roll (3) by the same amount Δ, thus reducing roll gap D. Since this embodiment employs the draft device as the pusher, when the rolling mill is removed from the rolling line, the hydraulic motor (25) is disconnected from the hydraulic pump (not shown) and the rotational torque of the shaft (26) is set to a given value by a torque wrench so that the push force acting between the rolls remains constant. It is understood that the pusher is not limited to the mechanism shown in FIG. 7; any device may be used so long as it can produce a constant push force.

The above-described method removes the backlash of the rolls such that rolling conditions are substantially reproduced.

A push force not substantially larger than the total weight of the rolls (3), (4), bearing (22), bearing case (23) or eccentric bearing case (32) and support shafts (15) (refer to FIG. 5) is preferable for pushing the rolls. If the push force is excessively large, the rolls become worn or deformed by rotating in contact with neighboring horizontal or vertical rolls, thereby lowering machining accuracy. In this embodiment, cutting was carried out with a push force of 1.5 tons on a total weight of approximately 1 ton.

Since horizontal roll drive source (10) and vertical roll drive sources (11) are fixed on the trucks (20), the supply of rotational power to rolls (3) and (4) can be switched (refer to FIG. 2).

As described above, the reference column is disposed on the outside surface of the two-roll, three-roll and four-roll rolling mill, and each roll is cut after being positionally aligned with respect to the cutting tool. The alignment is carried out by causing the contact sensor to come into contact with the reference column; thus, the respective rolls can be cut in the state that they are mounted on the rolling mill. Consequently, the dangerous and expensive operation of mounting and dismounting the rolls is eliminated, which contributes greatly to improved productivity and safety in a rolling line.

Since the backlash of the respective rolls in the thrust direction and pass line direction thereof is removed by causing the outside peripheral surfaces of the respective rolls to lightly come into contact with each other in the cutting operation, a special backlash preventing device (such as a radial preload mechanism or the like) is unnecessary. Moreover, since the rolls are cut while in a state similar to actual rolling operation, machining accuracy is increased.

Further, when an extendible and contractible contact sensor is employed, sensor contact with the roll in cutting operation is prevented, thus facilitating the roll cutting operation.

Although this invention has been described with reference to specific forms of apparatus and method steps, equivalent steps may be substituted, the sequence of the steps may be varied, and certain steps may be used independently of others. Further, various other control steps may be included, all without departing from the spirit and scope of the invention defined in the appended claims.

What is claimed is:

1. A roll cutting apparatus for cutting concave roll calibers, comprising:

a) a rolling mill, said mill including horizontal and vertical rolls, each of said rolls having an outside peripheral surface provided with a concave caliber formed on said outside peripheral surface, said rolls being mounted on said mill, said mill having a pass line arranged by disposing said rolls so that said outside peripheral surfaces are close to each other;

b) a base table, on which said mill is fixed at a predetermined position;

c) a cutting machine, said cutting machine having a cutting tool for cutting the calibers of said rolls, said cutting machine being movably connected to said base table;

d) a position alignment sensor, attached to said cutting machine, for aligning said cutting tool with said mill;

e) a position adjusting device, connected to said base table, for adjusting the relative positions of said mill and said cutting tool;

f) a vertical drive unit, detachably connected to said vertical rolls, for rotating said vertical rolls; and g) a horizontal drive unit, detachably connected to said horizontal rolls, for rotating said horizontal rolls.

2. A roll cutting apparatus according to claim 1, further comprising a pusher detachably connected to said vertical and horizontal rolls, wherein said pusher is capable of pushing said vertical and horizontal rolls toward said pass line such that backlash of said rolls is removed when said rolls are cut.

3. A roll cutting apparatus according to claim 2, wherein said pusher is a draft device of said mill.

4. A roll cutting apparatus according to any of claims 1, 2 or 3, wherein said position alignment sensor further comprises at least two sensors, one sensor disposed at said predetermined position of said mill, and the other sensor disposed on said cutting machine at a first predetermined distance from said cutting tool.

5. A roll cutting apparatus according to claim 4, wherein said mill has an outside surface, said roll cutting apparatus further comprising means providing a reference point located on said outside surface of said mill at a position spaced from said pass line by a second predetermined distance, such that said sensor disposed on said cutting machine can detect said reference point.

6. A roll cutting apparatus according to claim 5, wherein said means providing a reference point is a reference column disposed on the outside surface of said mill at a position spaced from said pass line by a third predetermined distance, and wherein said sensor is a contact sensor disposed on said cutting machine such that said contact sensor can detect the presence of said reference column.

7. A roll cutting apparatus according to claim 6, wherein said contact sensor is extendible and contractible.

8. A roll cutting apparatus according to claim 1, wherein said position adjusting device is a position adjusting table movable in three dimensions.

9. A roll cutting apparatus according to claim 1, wherein each of said rolls is engaged with a rotatable support shaft, and wherein said horizontal drive unit comprises a horizontal roll drive source which is movably disposed and detachably connected to said support shaft of each of said horizontal rolls, such that said horizontal rolls can be rotated during cutting operations, and said vertical drive unit comprises a vertical roll drive source which is movably disposed and detachably connected to said support shaft of each of said vertical rolls, such that said vertical rolls can be rotated during cutting operations.

10. A roll cutting apparatus according to claim 9, further comprising a male gear disposed on each of said support shafts, and a female gear disposed on each of said drive units, whereby each of said support shafts may be connected to and disconnected from a drive unit through engagement and disengagement of said male gear and said female gear.

* * * * *